US007423380B2

(12) United States Patent
Ota et al.

(10) Patent No.: US 7,423,380 B2
(45) Date of Patent: Sep. 9, 2008

(54) METAL HALIDE LAMP THAT HAS DESIRED COLOR CHARACTERISTIC AND IS PREVENTED FROM NON-LIGHTING DUE TO LEAKAGE OF ARC TUBE ATTRIBUTABLE TO CRACK OCCURRING AT THIN TUBE, AND LIGHTING APPARATUS ADOPTING THE METAL HALIDE LAMP

(75) Inventors: Isao Ota, Funai-gun (JP); Kazuo Takeda, Sakai (JP); Kazushige Sakamoto, Otsu (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 168 days.

(21) Appl. No.: 11/197,850

(22) Filed: Aug. 5, 2005

(65) Prior Publication Data

US 2006/0049765 A1 Mar. 9, 2006

(30) Foreign Application Priority Data

Aug. 6, 2004 (JP) ..... 2004-231232

(51) Int. Cl.
*H01J 17/20* (2006.01)
*H01J 61/18* (2006.01)

(52) U.S. Cl. ..... 313/638

(58) Field of Classification Search ..... None
See application file for complete search history.

(56) References Cited

U.S. PATENT DOCUMENTS 6,501,220 B1 * 12/2002 Lambrechts et al. ..... 313/571
6,717,364 B1 * 4/2004 Zhu et al. ..... 313/642
2006/0108930 A1 * 5/2006 Brock et al. ..... 313/640

FOREIGN PATENT DOCUMENTS

EP 1180786 A2 * 2/2002
JP 2002-042728 8/2002

* cited by examiner

*Primary Examiner*—Toan Ton
*Assistant Examiner*—Britt Hanley

(57) ABSTRACT

Provided is a metal halide lamp capable of being dimmed, which is prevented from non-lighting due to leakage of an arc tube attributable to a crack occurring at thin tubes, as well as realizing a desired color characteristic. The metal halide lamp has an arc tube that includes an envelope made of translucent ceramic, a pair of electrodes, and metal halides, the metal halides including rare earth metal halide, sodium halide, and magnesium halide, the rare earth metal halide being at least one of dysprosium halide, thulium halide, holmium halide, cerium halide, and praseodymium halide, and the magnesium halide being at least one of magnesium iodide and magnesium bromide, where when a maximum lamp power P (W) is in a range of 70 W to 250 W, the following relations are satisfied:

$$0.0345A+0.0028B<0.0015P+0.0475;$$

$$A\geqq 0.021P+0.313; \text{ and}$$

$$B\geqq 10.0,$$

where A (mg) represents a total content of the metal halides, and B (mol %) represents a content ratio of the magnesium halide to the metal halides.

6 Claims, 6 Drawing Sheets

METAL HALIDE LAMP THAT HAS DESIRED COLOR CHARACTERISTIC AND IS PREVENTED FROM NON-LIGHTING DUE TO LEAKAGE OF ARC TUBE ATTRIBUTABLE TO CRACK OCCURRING AT THIN TUBE, AND LIGHTING APPARATUS ADOPTING THE METAL HALIDE LAMP

BACKGROUND OF THE INVENTION (1) Field of the Invention

The present invention relates to a metal halide lamp and to a lighting apparatus adopting the metal halide lamp. In particular, the present invention relates to a technology for obtaining a desired color characteristic as well as preventing thin tubes from cracking, in a ceramic metal halide lamp capable of being dimmed.

(2) Related Art

Recently, from a point of view of power saving, metal halide lamps that can be dimmed are desired. Specifically, such lamps are to be normally lit at high lamp power (rated power), while having a function of being lit at lower lamp power when not so much light is required.

In a metal halide lamp whose envelope is made of translucent ceramic (hereinafter referred to as "ceramic metal halide lamp"), various types of rare earth metal halides are enclosed, such as dysprosium halide, thulium halide, holmium halide, cerium halide, and praseodymium halide. The envelope is made up of: a main tube in which a pair of electrodes are positioned; and two thin tubes provided at both ends of the main tube. In each of the thin tubes, a power feeder whose tip is provided with a corresponding one of the electrodes is inserted.

When such a ceramic metal halide lamp is lit using a dimming-control function, the color temperature (K) differs between a condition under which the lamp is lit under low lamp power, and a condition under which the lamp is lit under high lamp power. This happens in the following way. When a ceramic metal halide lamp is lit under low lamp power, a temperature of the coolest-spot in the arc tube becomes lower than when the lamp is lit under high lamp power, and accordingly the vapor pressure of each luminous material becomes lower than under high lamp power. However, the ratio of vapor-pressure reduction is different for each luminous metal, and so the distribution of light emission spectrum will change. For example, for a conventional ceramic metal halide lamp of lamp power of 150 W in which dysprosium iodide ($DyI_3$), thulium iodide ($TmI_3$), holmium iodide ($HoI_3$), and thallium iodide (TlI) are enclosed as luminous materials, the color temperature was 4300K, and Duv (displacement of chromaticity coordinates (u,v) from the Planckian locus) was 0. When this conventional lamp was lit under dimming control of 60% (i.e. lamp power of 90 W), the color temperature was 5100K, and the Duv was 20. This is attributed to a fact that the reduction ratio of the vapor pressure is smaller for thallium iodide than for dysprosium iodide, thulium iodide, and holmium iodide.

In view of this, a ceramic metal halide lamp that uses magnesium halide instead of thallium iodide has been proposed, so as to realize even reduction of vapor pressure for each luminous material when the lamp is lit under low lamp power (e.g. patent reference 1: Japanese Laid-open patent application No. 2002-42728).

The inventors of the present invention, in view of this patent reference 1, produced and evaluated ceramic metal halide lamps that contain magnesium iodide ($MgI_2$) as aluminous material instead of thallium iodide, in addition to dysprosium iodide, thulium iodide, and holmium iodide. The ceramic metal halide lamps have maximum lamp power of 150 W and minimum lamp power of 90 W.

Note that the content of the magnesium iodide is controlled to be 5%-50% of the total molar quantity of the metal halides.

A life test was conducted to thus produced lamps, by lighting them with a maximum lamp power of 150 W, without performing dimming control. The result is unexpected in a sense that the lamps stopped lighting up after about 4500 hours has passed after the lighting start, where the lamp rated life is 9000 hours. During examination for the cause, cracks were found at one of the ends of the thin tubes that is nearer the main tube. Therefore, it is considered that the leakage due to such cracks has caused the non-lighting of the lamps. Furthermore, the cracks are considered to have occurred at one of the ends of the thin tubes which is nearer the main tube, in the following manner. In an inner surface of one of the ends of the thin tubes that is nearer the main tube, the ceramic constituting the thin tubes reacted with the luminous materials (i.e. luminous metal) to be eroded. As a result, the ceramic lost its mechanical strength. Therefore, the selection and composition of luminous materials disclosed in the patent reference 1 are considered to have facilitated the reaction between the luminous materials and the ceramic, thereby causing the thin tubes to crack.

However, there is no practical substitute for the selection of luminous material as disclosed in the patent reference 1, to been closed in a ceramic metal halide lamp capable of being dimmed. Reduction in content of the luminous materials has been also considered so as to restrain the reaction with the ceramic. However, this is not a practical measure either, because it is expected to reduce the vapor pressure of each luminous material during the lamp slighting, which would impair the desired color characteristics.

SUMMARY OF THE INVENTION

The present invention, having been conceived in light of the aforementioned problems, has an object of providing a dimmable metal halide lamp that is prevented from non-lighting due to leakage of an arc tube attributable to a crack occurring at thin tubes, as well as realizing a desired color characteristic, where the metal halide lamp includes rare earth metal halide, sodium halide, and magnesium halide, the rare earth metal halide being at least one of dysprosium halide, thulium halide, holmium halide, cerium halide, and praseodymium halide, and the magnesium halide being at least one of magnesium iodide and magnesium bromide.

The metal halide lamp of the present invention is a metal halide lamp capable of being dimmed having an arc tube that includes an envelope made of translucent ceramic, a pair of electrodes, and metal halides, the metal halides including rare earth metal halide, sodium halide, and magnesium halide, the rare earth metal halide being at least one of dysprosium halide, thulium halide, holmium halide, cerium halide, and praseodymium halide, and the magnesium halide being at least one of magnesium iodide and magnesium bromide, where when a maximum lamp power P (W) is in a range of 70 W to 250 W, the following relations are satisfied:

$$0.0345A+0.0028B<0.0015P+0.0475,$$

$$A\geqq 0.021P+0.313, \text{ and}$$

$$B\geqq 10.0,$$

where A (mg) represents a total content of the metal halides excluding mercury halide if any, and B (mol %) represents a content ratio of the magnesium halide to the metal halides excluding mercury halide if any.

In particular, it is desirable that each of the pair of electrodes is made of an electrode rod and an electrode coil provided at a tip of the electrode rod, and that where C (mm) represents a diameter of the electrode rod, the following relation is satisfied:

$$0.0018P+0.190 \geqq C \geqq 0.0011P+0.171.$$

According to the above-stated structure of the metal halide lamp of the present invention, it is possible to prevent non-lighting due to leakage of its arc tube attributable to a crack occurring at the thin tubes, as well as realizing a desired color characteristic.

In addition, the lighting apparatus according to the present invention has a structure in which the above-stated metal halide lamp is incorporated in the luminaire.

According to the above-stated structure of the lighting apparatus of the present invention, it is possible to realize a desired color characteristic, and prevent the occurrence of non-lighting of its lamp.

BRIEF DESCRIPTION OF THE DRAWINGS

These and other objects, advantages and features of the invention will become apparent from the following description thereof taken in conjunction with the accompanying drawings that illustrate a specific embodiment of the invention. In the drawings.

DESCRIPTION OF THE PREFERRED EMBODIMENTS

Embodiment

As follows, the best mode of the present invention is described with reference to the drawings.

Figure 1:
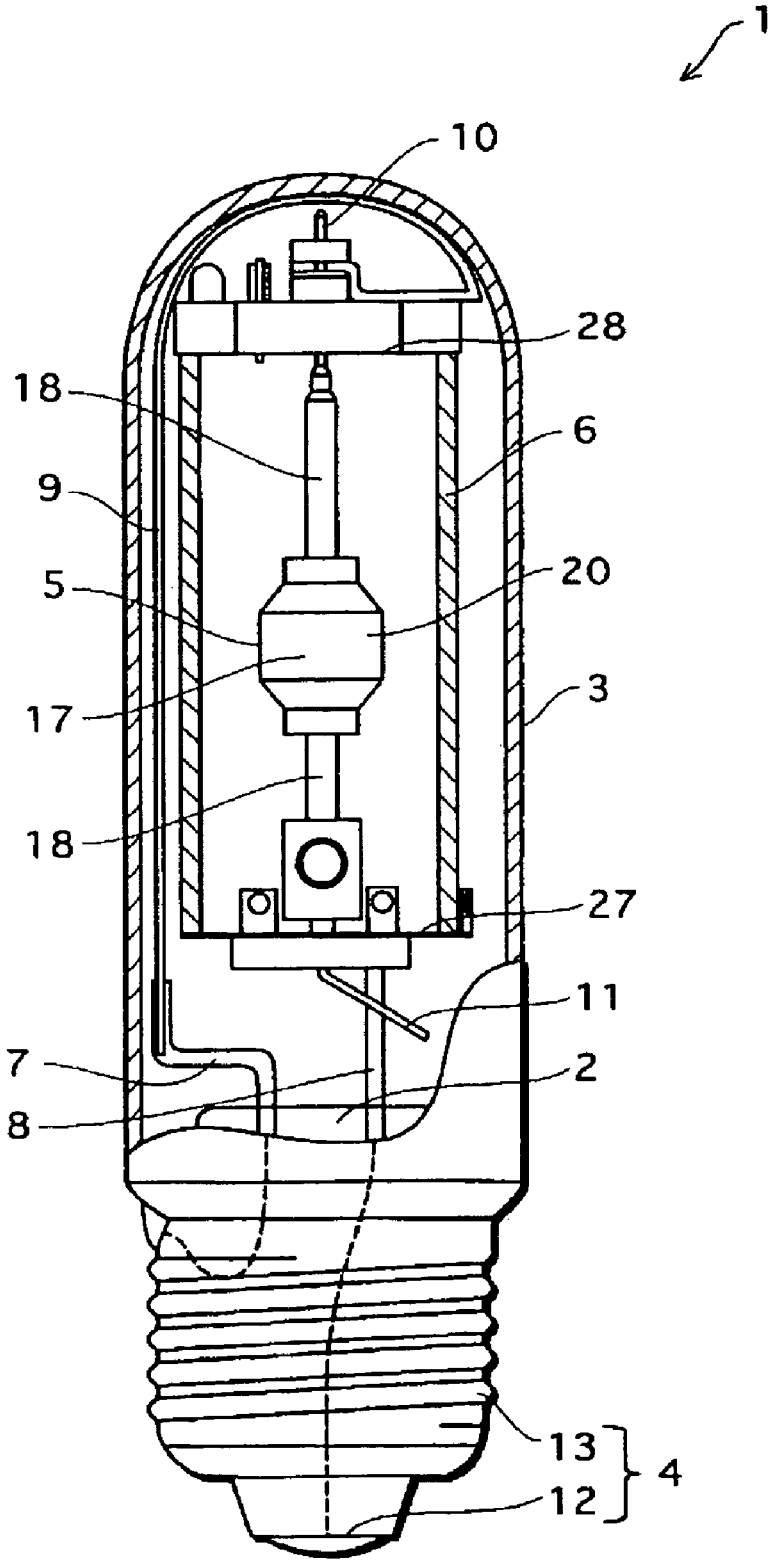
FIG. 1 is a front view of a metal halide lamp capable of being dimmed (hereinafter "dimmable metal halide lamp"), according to an embodiment of the present invention, which is partly cut.

FIG. 1 shows a dimmable metal halide lamp 1, according to an embodiment of the present invention. As FIG. 1 shows, the metal halide lamp 1 includes: an outer tube 3 (e.g. made of hard glass) whose one end is closed and substantially in a hemispherical shape and whose other end is sealed by a stem 2; a base 4 (e.g. E-type base) attached to the end of the outer tube 3 sealed by the stem 2; an arc tube 5 placed inside the outer tube 3; and a sleeve 6 made of quartz glass in a tubular form. The sleeve 6 is interposed between the outer tube 3 and the arc tube 5, so as to prevent the outer tube 3 from being broken in the event of breakage of the arc tube 5.

The metal halide lamp 1 has a rated lamp power (i.e. maximum lamp power) of 150 W which is used normally, and the minimum lamp power of 90 W which is used under the dimming control. This means that under the dimming control, power reduction to 60% of the rated lamp power is possible. For example, the metal halide lamp 1 can be for use as an indoor lighting such as in shops.

The stem 2 is provided with two stem lines 7 and 8. one of the ends of each stem line 7 (8) is introduced into the outer tube 3. The end of the stem line 7 is electrically and mechanically connected via a power supply line 9 to an outer lead wire 10 of the arc tube 5. The end of the stem line 8 is electrically and mechanically connected to an outer lead wire 11 of the arc tube 5. The outer lead wires 10 and 11 will be described later. This means that the arc tube 5 is held in the outer tube 3 via the stem lines 7 and 8, and via the power supply line 9. The other end of the stem line 7 is electrically connected to an eyelet member 13 of the base 4, and the other end of the stem line 8 is electrically connected to a shell member 12 of the base 4.

Note that each stem line 7 (8) is usually a component produced by connecting a plurality of metal wires.

Nitrogen gas is enclosed in the outer tube 3. However, the outer tube 3 may be evacuated instead, without enclosure of nitrogen gas.

The base 4 is not limited to the E-type, and may alternatively be a P-type formed like a pin.

Figure 2:
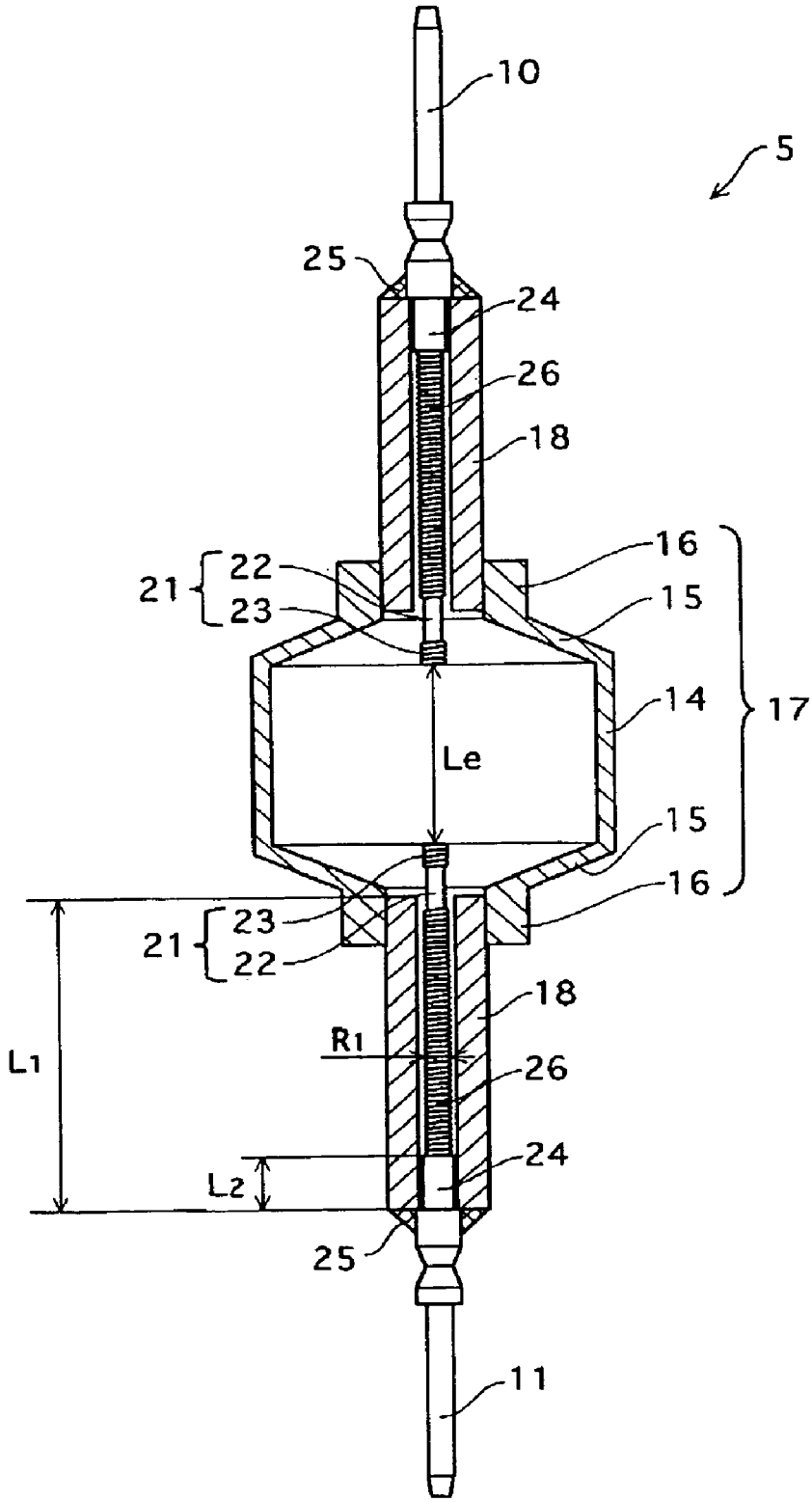
FIG. 2 is a front cross-sectional view of an arc tube used in the dimmable metal halide lamp.

The arc tube 5 includes an envelope 19 made of translucent ceramic such as polycrystalline alumina. As FIG. 2 shows, the envelope 19 is constituted by a main tube 17 and two thin tubes 18. The main tube 17 includes: a first tubular portion 14 substantially in a tubular form; two tapering portions 15 respectively formed at both ends of the first tubular portion 14; and two second tubular portions 16 in a tubular form that is smaller in diameter than the first tubular portion 14, and are respectively formed at opening ends of the tapering portions 15. Each thin tube 18 is shrink fit to a corresponding one of the second tubular portions 16, at one end.

In the envelope 19 of the above-described example, the main tube 17 and the thin tubes 18 are formed independently, and then are integrated by shrink fit. However, the envelope 19 is not limited to such a structure, and may alternatively be one-piece in which the main tube and the thin tubes are integrally formed. In other words, the envelope 19 may be such that its main tube and thin tubes are simultaneously formed as one integral body. Moreover, the main tube 17 is explained to have the first tubular portion 14, the tapering portions 15, and the second tubular portions 16. However, the main tube 17 is not limited to the described form, and may be any of the conventional forms, such as a simply tubular form, and a tubular form except that each end thereof is formed like a hemisphere. In addition, the material of the envelope is not limited to polycrystalline alumina. For example, the envelope 19 may be made of translucent ceramic such as yttrium-aluminum-garnet (YAG), yttria, and zirconia.

As shown in FIG. 1, the arc tube 5 is provided with an adjacent material flame 20 that is positioned either in the vicinity or in contact with the outer surface of the main tube 17. Ends of the adjacent material flame 20 are wound around the thin tubes 18, respectively.

The tube wall load of the arc tube 5 is set as 27 W/cm$^2$, for example.

What is meant by "tube wall load" is a value obtained by dividing the maximum lamp power P(W) by the total inner surface area of the arc tube S. Here the "total inner surface area" is obtained by calculating a total inner surface area of the main tube 17, by closing respective openings of the thin tubes 18 that are nearer the main tube 17 under assumption that electrodes 21 do not exist in the arc tube 5 of FIG. 2. Therefore the total inner surface area of the arc tube 5 obtained in this way includes an inner surface area corresponding to the openings of thus closed thin tubes 18.

As FIG. 2 shows, a pair of electrodes 21 are provided in the main tube 17, so as to substantially oppose each other. In addition, metal halides as luminous materials, mercury as a buffer gas, and a rare gas as a start auxiliary gas are respectively enclosed in the main tube 17. The content of mercury is adjusted so as to generate a predetermined level of lamp voltage during the stable lighting period. For example, 10 mg of mercury is enclosed, so as to generate lamp voltage of 90V. An example of the start auxiliary gas is argon, and its content is set so that it is 20 kPa at room temperature (25 degrees centigrade) for example. Needless to say, the start auxiliary gas may alternatively be xenon, or a mixture of xenon, and argon, for example.

Figure 3:
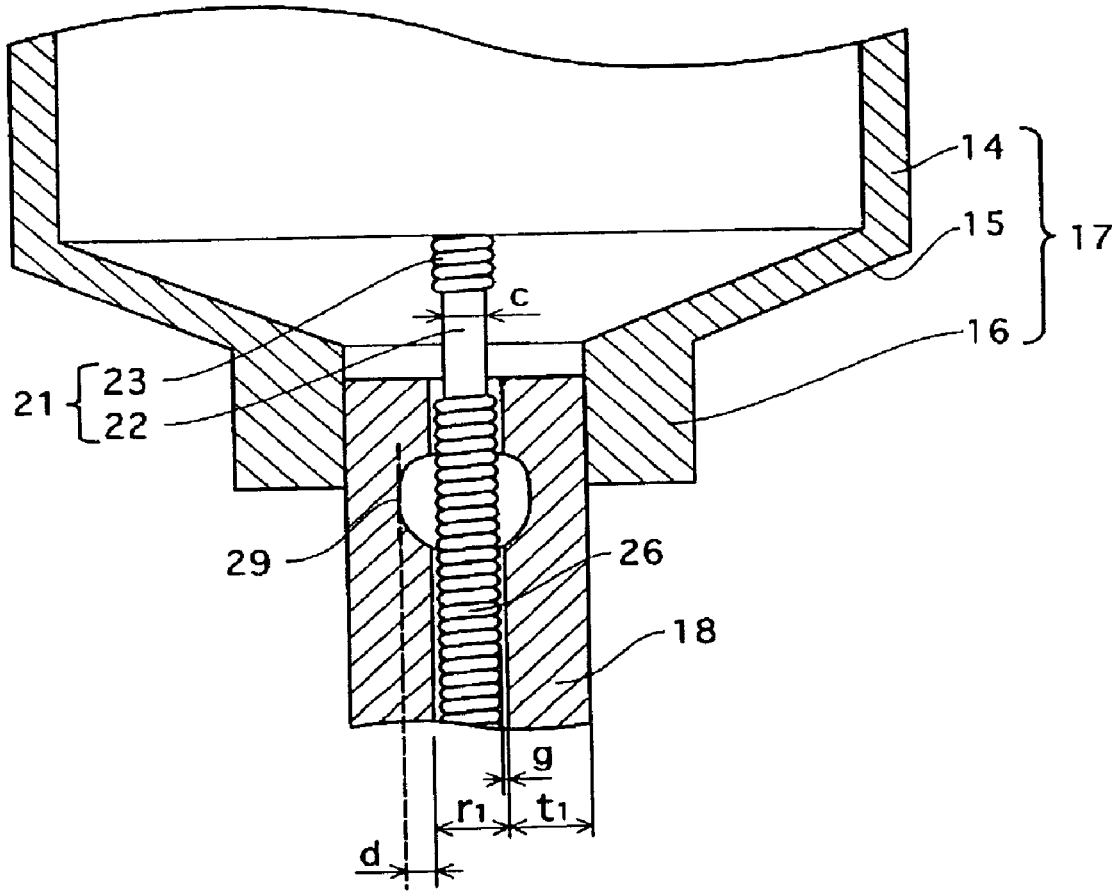
FIG. 3 is an enlarged cross-sectional view of a main part of the arc tube used for the dimmable metal halide lamp.

Each of the electrodes 21 is made of a tungsten electrode rod 22 and a tungsten electrode coil 23 provided at the tip of the electrode rod 22. The distance "Le" between the electrodes 21 is 9 mm-11 mm (e.g. 10.0 mm). For a reason detailed later, it is desirable to satisfy the relation of $0.0018P+0.190 \geqq c \geqq 0.0011P+0.171$, where the maximum lamp power P(W) is in the range of 70 W to 250 W and the diameter of the electrode rods 22 is C(mm) (see FIG. 3). Note that the maximum lamp power P(W) corresponds to the rated lamp power.

The metal halides enclosed include rare earth metal halide, sodium halide, and magnesium halide, the rare earth metal halide being at least one of dysprosium halide, thulium halide, holmium halide, cerium halide, and praseodymium halide, and the magnesium halide being at least one of magnesium iodide ($MgI_2$) and magnesium bromide ($MgBr_2$). Needless to say, for the purpose of obtaining a desired color characteristic and so on, publicly-known metal halides may also be added, such as calcium iodide ($CaI_2$), lithium iodide (LiI), indium iodide (InI), and scandium iodide ($ScI_3$). It is possible to obtain a desired color characteristic by adjusting the selection and composition of the stated metal halides in an appropriate manner.

From a reason detailed later, it is desirable to satisfy the relations of $0.0345A+0.0028B<0.0015P+0.0475$, $A \geqq 0.021P+0.313$, and $B \geqq 10.0$, where the maximum lamp power P(W) is in the range of 70 W to 250 W and the total content of the metal halides (excluding mercury halide if any) is A (mg), and the content ratio of magnesium halide to the total metal halides (excluding mercury halide if any) is B(mol %).

Note that the reason why mercury halide is not taken into account in the above-stated relations is because mercury halide does not contribute to light emission in a practical sense.

Each thin tube 18 has dimensions of: length $L_1$ of 16.0 mm-17.0 mm (e.g. 16.8 mm); and material thickness $t_1$ (see FIG. 3) of 0.9 mm-1.3 mm (e.g. 0.9 mm). If the material thickness $t_1$ is made to be too thick, the heat capacity of the thin tubes 18 becomes large, thereby reducing the temperature at the coolest spot of the arc tube 5 and decreasing the vapor pressure of the luminous materials during the lamp's lighting. In this case, it is feared that the average color rendering index Ra is lowered. On the contrary, if the material thickness t1 is made to be too thin, it is feared that the thin tubes 18 are broken due to impact incident to shipping of the lamp, and so on. Therefore, it is desirable that the material thickness $t_1$ of the thin tubes 18 is set in the range of 0.9 mm to 1.3 mm.

In addition, parts of power feeders 24 are inserted to the thin tubes 18, respectively. Each power feeder 24 is made of a conductive thermet, which is obtained by sintering the mixture of alumina ($Al_2O_3$) and molybdenum (Mo). The tip of each power feeder 24 is connected to an electrode rod 22 of an electrode 21. The portion of each power feeder 24, which is positioned in a corresponding thin tube 18, is substantially entirely covered by a corresponding glass frit 24 flown from one of the ends of the thin tube 18 that is farther from the main tube 17 from the other end, and into a space between the thin tube 18 and the power feeder 24. A length "L2" of the portion of each power feeder 24 covered by a corresponding glass frit is 3.35 mm, for example. The portions of the power feeders 24 that are positioned outside the thin tubes 18 are electrically connected to the outer lead wires 10 and 11, respectively. The outer lead wires 10 and 11 are made of niobium, for example. Note that the outer lead wire 11 is not bent in FIG. 2.

Coils 26, for example made of molybdenum, are provided in the thin tubes 18 respectively, in a state that each coil 26 is tightly wound around the outer surface of a corresponding electrode rod 22. Each of the coils 26 functions to fill the gap between a corresponding thin tube 18 and a corresponding electrode rod 22 as tight as possible, for the purpose of preventing the metal halide in liquid form from entering the gap. The outer diameter $R_1$ of each coil 26 is set to be a slightly smaller than the inner diameter $r_1$ of each thin tube 18, so as to allocate space sufficient for insertion of the electrode rod 22 and a corresponding coil 26 wound therearound even there is size variation for each component. In view of this designing, there will be formed a gap of 0.01 mm-0.15 mm between a thin tube 18 and a corresponding coil 26, on the premise that the lengthwise axis of the coil 26 coincides with the lengthwise axis of the thin tube 18. Needless to say, an electrode 21 is inserted by decentering with respect to a thin tube 18, and sometimes part of the coil 26 is in contact with an inner surface of the thin tube 18.

An electrode assembly, which is constituted by an outer lead wire 10 (or 11), an electrode 21, a power feeder 24, and a coil 26, is not limited to the materials and structures stated above. Various types of materials and structures, which are publicly known, are also usable.

As FIG. 1 shows, the sleeve 6 is held by metal plates 27 and 28 whose ends are held by the stem lines 7 and 8. However, other publicly-known means may also be used to hold the sleeve 6.

The following details the reason why it is set to satisfy the relations of $0.0345A+0.0028B<0.0015P+0.0475$, $A \geqq 0.021P+0.313$, and $B \geqq 10.0$, where the maximum lamp power P(W) is in the range of 70 W to 250 W, the total content of the metal halides (excluding mercury halide if any) is A (mg), and the content ratio of magnesium halide to the total metal halides (excluding mercury halide if any) is B(mol %).

Lamps a and b are respectively produced based on the dimmable metal halide lamp 1 according to the embodiment of the present invention described above. In Lamp a, thulium iodide ($TmI_3$), holmium iodide ($HoI_3$), magnesium iodide ($MgI_2$), and sodium iodide (NaI) are enclosed as metal halides, and the content B of magnesium iodide to the total metal halides is set as 27 mol %. In Lamp b, too, thulium iodide ($TmI_3$), holmium iodide ($HoI_3$), magnesium iodide ($MgI_2$), and sodium iodide (NaI) are enclosed as metal halides, except that the content B of magnesium iodide to the total metal halides is set as 40 mol %.

The lamps a and b were respectively lit using a publicly-known electronic ballast and with maximum lamp power of 150 W, and by changing the total content A (mg) of metal halides as Table 1 shows, and occurrence of non-lighting attributable to leakage of the arc tube 5 by the time 9000 hours passes after the lamp is started to light up (hereinafter, "lighting elapse time") was inspected. Note that this lighting elapse time of 9000 hours corresponds to a rated life of lamps. The result is also shown in Table 1.

The material thickness $t_1$ of the thin tubes 18 is set as 0.9 mm in both of the lamps a and b. The maximum gap g (FIG. 3) formed between a thin tube 18 and a corresponding coil 26 was 0.10 mm. The lamps a and b were lit in repeated cycles, where in each cycle, the lamps were lit for 5.5 hours and then extinguished for 0.5 hour. Accordingly, the lighting elapse time indicates an accumulated lighting time period. Note that in the above test, the lamp power during lighting is always controlled to 150 W, without dimming control.

For Lamp a, a content ratio (mol %) of each metal halide is: $TmI_3$:$HoI_3$:$MgI_2$:NaI=22:5:27:46. Whereas for Lamp b, a content ratio (mol %) of each metal halide is: $TmI_3$:$HoI_3$:$MgI_2$:NaI=17:3:40:40. Each of Lamps a and b is set to render a color temperature of 4300K. In the same way, each of Lamps c and d, which will be described later, is set to render a color temperature of 4300K.

TABLE 1

| | Content ratio B (mol %) | Total content A (mg) | Occurrence of non-lighting | Evaluation |
|---|---|---|---|---|
| Lamp a | 27 | 5.2 | No | Excellent |
| | | 5.7 | No | Excellent |
| | | 5.8 | Yes | Failure |
| Lamp b | 40 | 4.2 | No | Excellent |
| | | 4.7 | No | Excellent |
| | | 4.8 | Yes | Failure |

As Table 1 shows, in Lamp a (content ratio B=27 mol %), when the relation of 0.0345A+0.0028B<0.0015×150+0.0475 is satisfied (e.g. total content A is 5.2 mg and 5.7 mg), there is no lamp that caused non-lighting attributable to leakage of the arc tube 5 by the lighting elapse time of 9000 hours. As opposed to this, when the relation of 0.0345A+0.0028B<0.0015×150+0.0475 is not satisfied (e.g. total content A is 5.8 mg), part of thin tubes 18 nearer the main tube 17 cracked by the lighting elapse time of 9000 hours (e.g. around 4500 hours of lighting elapse time), causing leakage of the arc tube 5. In this way, Lamp a stopped lighting up.

On the other hand, in Lamp b (content ratio B=40 mol %), when the relation of 0.0345A+0.0028B<0.0015×150+0.0475 is satisfied (e.g. total content A is 4.2 mg and 4.7 mg), there is no lamp that caused non-lighting attributable to leakage of the arc tube 5 by the lighting elapse time of 9000 hours. As opposed to this, when the relation of 0.0345A+0.0028B<0.0015×150+0.0475 is not satisfied (e.g. total content A is 4.8 mg), part of thin tubes 18 nearer the main tube 17 cracked by the lighting elapse time of 9000 hours (e.g. around 4500 hours of lighting elapse time), causing leakage of the arc tube 5. In this way, the lamp b stopped lighting up.

In this way, it is confirmed that non-lighting of a lamp incident to leakage of the arc tube 5 does not occur by the lighting elapse time of 9000 hours, on condition that the relation of 0.0345A+0.0028B<0.0015×150+0.0475 is satisfied.

The reason for this result is considered as follows.

When the relation of 0.0345A+0.0028B<0.0015×150+0.0475 is not satisfied, a trace 29 of considerable erosion was found inside the end of the thin tubes 18 nearer the main tube 17 in each sample lamp. The reason for this is considered in the following way. A large amount of redundant metal halide in liquid form entered into the gap formed between a thin tube 18 and a corresponding coil 26, to react with polycrystalline alumina constituting the thin tube 18. Then, as the elapse of lighting time, the inside of the thin tube 18 is eroded deeply. As a result, the eroded part of the thin tube 18 has lost a considerable amount of mechanical strength, and cracked because of thermal shocks due to on/off of the lamp. This is considered how the leakage was caused. On the contrary, when the relation of 0.0345A+0.0028B<0.0015×150+0.0475 is satisfied, there is found a trace 29 inside the end of the thin tubes 18 nearer the main tube 17 in each sample lamp. However, the depth "d" (mm) of the eroded part of the trace 29 was considerably smaller than the above case. This is considered because the amount of liquid-form metal halide that flow between a thin tube 18 and a corresponding coil 26 is very small, and so the chemical reaction with polycrystalline alumina constituting the thin tube 18 is accordingly small. As a result, during the life of the lamp, the mechanical strength of the thin tubes 18 is considered strong enough to endure the thermal shocks due to on/off of the lamp.

Figure 4:
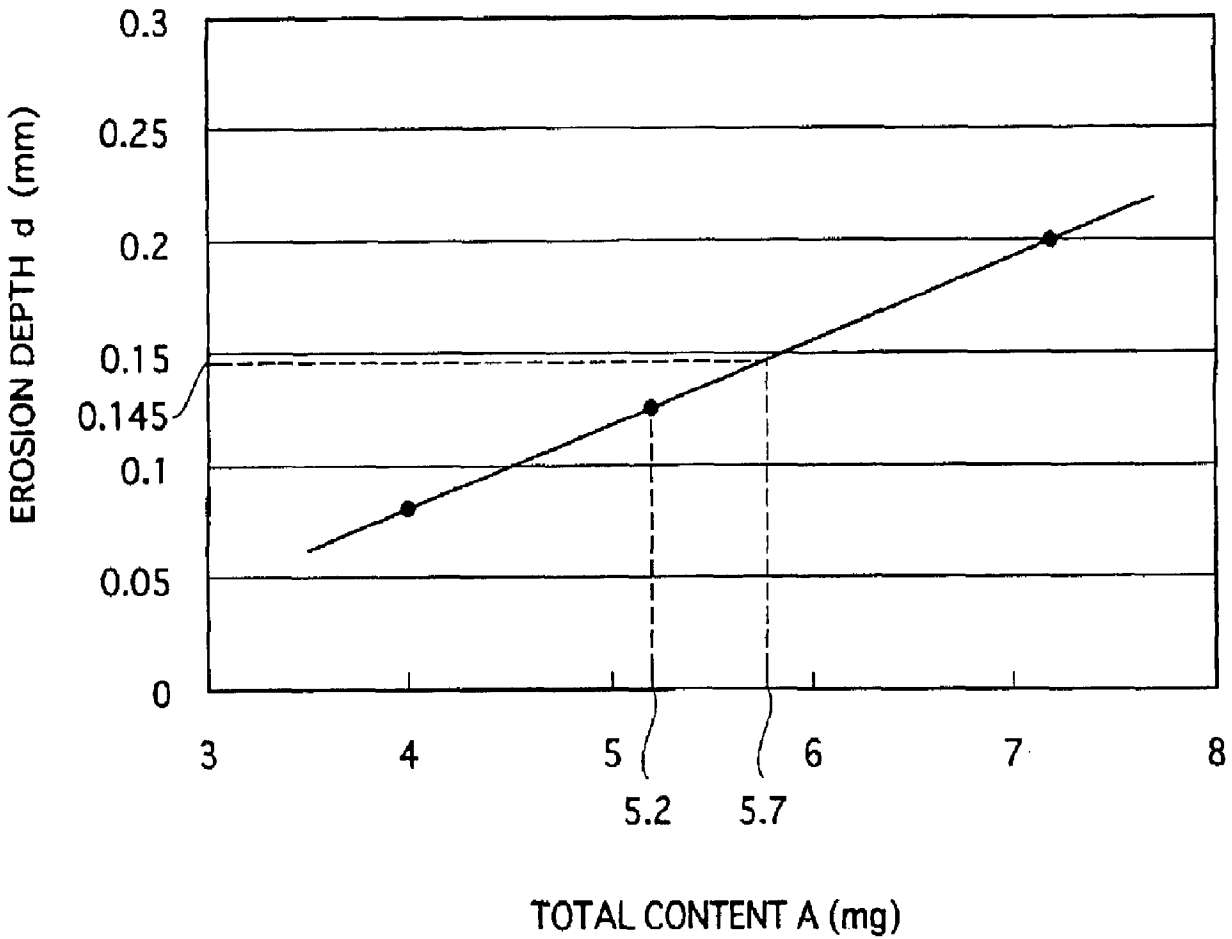
FIG. 4 is a diagram showing a relation between an erosion depth d (mm) and a total content A (mg)

For reference sake, FIG. 4 is presented to show the erosion depth d (mm) at the lighting elapse time of 9000 hours, for each value of A (mg) (i.e. total content of metal halides).

Figure 5:
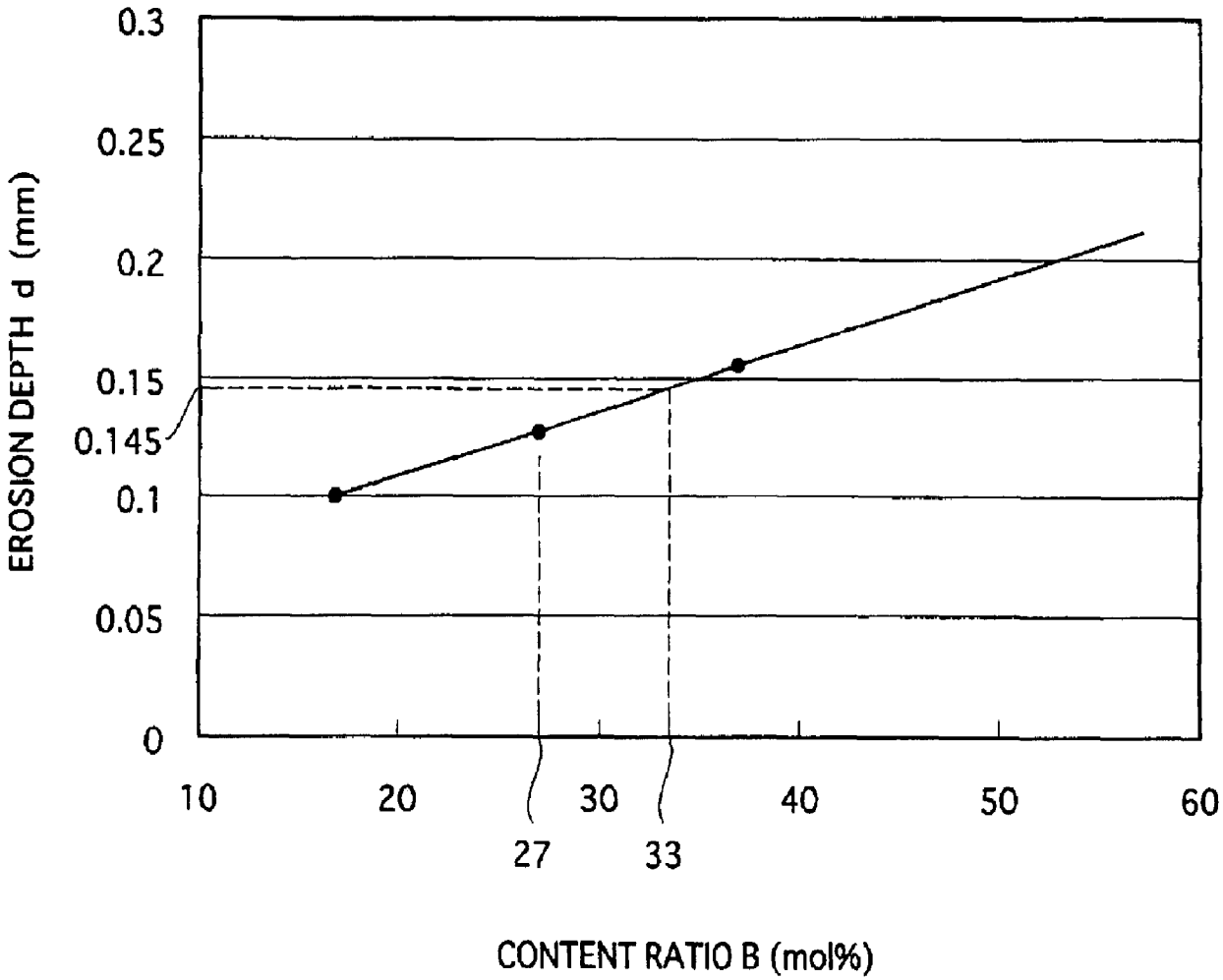
FIG. 5 is a diagram showing a relation between an erosion depth d (mm) and a content ratio B (mol %)

As is clear from FIG. 4, with the increase in total content A(mg) of the metal halides, the erosion depth d(mm) increases proportionally. FIG. 5 shows the erosion depth d(mm) at the lighting elapse time of 9000 hours with respect to change in the content ratio B(mol %) of magnesium halide to the total metal halides. Note that in FIG. 5, the total content A of metal halides is maintained constant to the value of 5.2 mg. As is clear from FIG. 5, with the increase in content ratio B(mol %) of magnesium halide to the total metal halides, the erosion depth d(mm) increases proportionally.

Note that the thin tubes 18 having material thickness $t_1$ of 0.9 mm were used in the above-described test. However, it has been confirmed that when the material thickness $t_1$ of the thin tubes 18 lies within the conventionally used range (e.g. 0.9 mm-1.3 mm), the similar result to as described above is obtained. In addition, the maximum gap g formed between a thin tube 18 and a corresponding coil 26 was 0.10 mm. However, it is considered possible to obtain the similar result to as described above, if the maximum gap g is in the range of 0.01 mm to 0.15 mm, for example, based on the relation between the inner diameter $r_1$ of a thin tube 18 and a maximum outer diameter $R_1$ of a coil 26. Furthermore, it was confirmed that the above-described result is obtainable if the relations of A≧0.021P+0.313 and B≧10.0 are both satisfied, regardless of the content ratio of each component.

As Table 2 shows, lamps respectively containing the total content A of 4.0 mg, 3.5 mg, and 3.4 mg were produced, which are even smaller than the smallest total content A used for the lamp a (5.2 mg). Each type of produced lamps was lit using a publicly-known electronic ballast with a rated lamp power (maximum lamp power) of 150 W and with 60% of the rated lamp power 150 W (minimum lamp power of 90 W), and a color temperature difference ΔT was measured. (Hereinafter, the event where a lamp is lit with the maximum lamp power is referred to as "(at/in/under) maximum lighting", and the event where a lamp is lit with the minimum lamp power of 90 W is referred to as "(at/in/under) lighting under dimming control".) Here, the color temperature difference ΔT is obtained by taking a difference between a color temperature (K) at the lighting elapse time of 100 hours and a color temperature (K) at the lighting elapse time of 9000 hours. The measured color temperature differences ΔT are shown in Table 2.

The evaluation criterion is ΔT≦400K, when ΔT lies in this range, it is hard to recognize the color temperature difference by visual inspection. In this test, the lamps were lit in repeated cycles, where in each cycle, the lamps were lit for 5.5 hours and then extinguished for 0.5 hour. Accordingly, the lighting elapse time indicates an accumulated lighting time period.

Note that in the above test, the maximum lamp power was always controlled to 150 W, and the lamp power under dimming control was always controlled to 90 w.

TABLE 2

| | Content ratio B (mol %) | Total content A (mg) | Color temperature difference ΔT(K) | Evaluation |
|---|---|---|---|---|
| Lamp a | 27 | 4.0 | 350 | Excellent |
| | | 3.5 | 400 | Excellent |
| | | 3.4 | 410 | Failure |

As Table 2 shows, the color temperature difference ΔT is the same in both under the maximum lamp power and under the dimming control. When the relation A≧0.021×150+0.313 is satisfied (e.g. when the total content A is 4.0 mg or 3.5 mg), the color temperature difference ΔT satisfies the above-stated evaluation criterion. As opposed to this, when the relation A≧0.021×150+0.313 is not satisfied (e.g. when the total content A is 3.4 mg), the color temperature difference ΔT falls below the above-stated evaluation criterion.

From the result, it is confirmed that when the total content A of metal halides satisfies the relation of A≧0.021×150+0.313, it is possible to restrain change of the color temperature with elapse of lighting time.

This result is considered attributable to the following reason.

When the total content A of the metal halides does not satisfy the relation of A≧0.021×150+0.313, it indicates that the total content A of metal halide is small in the initial stage. Under maximum lighting, the luminous metals that would contribute to light emission decreased in amount due to reaction with ceramic constituting the envelope 19, and so the total content A of metal halides became too low in quantity. Accordingly in the stable lighting, shortage in the vapor pressure from each luminous material was caused. In addition, in lighting under dimming control, the coolest-spot temperature of the arc tube 5 became low, which in turn increased the quantity of metal halides that sinks in the thin tubes 18. As a result, the luminous metals that would contribute to light emission decreased in quantity. Therefore in this case too, the total content A of metal halides became too low in quantity as in the above case, thereby leading to shortage in vapor pressure from each luminous material in the stable lighting. On the other hand, when the total content A of metal halides satisfies the relation of A≧0.021×150+0.313, the total content A of metal halides is in a proper level, and so a sufficient amount of vapor pressure from luminous metals was obtained in the stable lighting.

Next, lamps c are produced based on the dimmable metal halide lamp 1 according to the embodiment of the present invention described above. In Lamp c, thulium iodide ($TmI_3$), holmium iodide ($HoI_3$), magnesium iodide ($MgI_2$), and sodium iodide (NaI) are enclosed as metal halides (4.0 mg in total). The lamps c were respectively lit using a publicly-known electronic ballast and with maximum lamp power of 150 W, and by changing the content ratio B (mol %) of magnesium iodide to the total metal halides, and Duv (displacement of chromaticity coordinates (n,v) from the Planckian locus) was inspected. The result is shown in Table 3.

Note that the evaluation criterion is Duv of "−10.0 or above". This is because in this range, it is proved that the human eyes can recognize the color as white, in the examinations for chromaticness recognizable by human eyes.

TABLE 3

| | Total content A (mg) | Content ratio B (mol %) | Duv | Evaluation |
|---|---|---|---|---|
| Lamp c | 4.0 | 9.0 | −11.0 | Failure |
| | | 10.0 | −10.0 | Excellent |
| | | 17.0 | −8.9 | Excellent |
| | | 27.0 | −6.7 | Excellent |
| | | 37.0 | −5.2 | Excellent |

As Table 3 shows, when the content ratio B is 10.0 mol % or more (e.g. 10.0 mol %, 17.0 mol %, 27.0 mol %, and 37.0 mol %), the value of Duv satisfies the above-stated evaluation criterion. As opposed to this, when the content ratio B is below 10.0 mol % (e.g. 9.0 mol %), the value of Duv falls below the above-stated evaluation criterion, which indicates that human eyes would recognize the color of the lamp as reddish white.

From the result, it is confirmed that the color of white that human eyes would not recognize as reddish white is obtained when the content ratio B (mol %) of magnesium iodide to the total metal halides satisfies the relation of B≧10.0.

This result is considered attributable to the following reason.

When the content ratio B (mol %) of magnesium iodide to the total metal halides does not satisfy the relation of B≧10.0, the content of magnesium iodide is too small compared to the content of the other metal halides. Therefore, the light emission spectrum of magnesium iodide becomes too small. On the contrary, when the content ratio B (mol %) of magnesium iodide to the total metal halides satisfies the relation of B≧10.0, the content of magnesium iodide is appropriate with respect to the content of the other metal halides, thereby achieving an appropriate balance of the light emission spectrums among luminous materials.

To summarize, when the relations of 0.0345A+0.0028B<0.0015P+0.0475, A≧0.021P+0.313, and B≧10.0 are satisfied, where the total content of metal halides is A (mg) and the content ratio of magnesium iodide to the total metal halides is B (mol %), the following effects are produced. Namely, the color temperature change with elapse of lighting time is restrained, a desired color characteristic is obtained (in the sense that the color that human eyes would not recognize reddish white is obtained), and non-lighting due to leakage of the arc tube 5 is prevented.

The following describes the reason why the diameter C (mm) of the electrode rods is defined to satisfy the relation of 0.0018P+0.190≧C≧0.0011P+0.171.

Lamps d are produced based on the dimmable metal halide lamp 1 according to the embodiment of the present invention described above. In Lamp d, thulium iodide ($TmI_3$), holmium iodide ($HoI_3$), magnesium iodide ($MgI_2$), and sodium iodide (NaI) are enclosed as metal halides. The lamps d were respectively lit using a publicly-known electronic ballast by changing the diameter C(mm) of the electrode rods 22. The lamps d were lit with maximum lamp power of 150 W (maximum lighting) and under dimming control, i.e. with 60% of the rated lamp power 150 W (minimum lamp power of 90 W). Under the above conditions, luminous flux maintenance factor (%) at the lighting elapse time of 9000 hours and the occurrence of non-lighting before the life of the lamp were inspected. Table 4 shows the result.

Note that according to the change in diameter C of the electrode rod 22, the inner diameter $r_1$ of the thin tubes 18 is changed while keeping its material thickness $t_1$ constant (0.9 mm). Also in this test, the total content A of the metal halides was 4.0 mg, and the content ratio of each metal halide (mol %) was set as:

$TmI_3:HoI_3:MgI_2:NaI=25:5:22:48.$

Furthermore in the test, the lamps d were lit in repeated cycles, where in each cycle, the lamps were lit for 5.5 hours and then extinguished for 0.5 hour. Accordingly, the lighting elapse time indicates an accumulated lighting time period. Note that the maximum lamp power was always controlled to 150 W, and the lamp power under dimming control was always controlled to 90 W. However, the luminous flux was always measured under the rated lamp power of 150 W.

Here, the luminous flux maintenance factor is represented by a ratio (%) of the luminous flux at the lighting elapse time of 9000 hours, where the luminous flux (lm) at the lighting elapse time of 100 hours is assumed to be 100 In addition, the evaluation criterion is set as 60% or above, from a practical point of view.

TABLE 4

| | Diameter | Luminous flux maintenance factor at 9000 hours of lighting elapse time (%) | | | |
|---|---|---|---|---|---|
| | C of electrode rod (mm) | At maximum lighting (150 W) | Under dimming control (90 W) | Occurrence of non-lighting | Evaluation |
| Lamp d | 0.30 | 58 | 68 | Yes | Failure |
| | 0.34 | 60 | 67 | No | Excellent |
| | 0.40 | 65 | 65 | No | Excellent |
| | 0.46 | 71 | 61 | No | Excellent |
| | 0.47 | 71 | 59 | No | Failure |

As Table 4 shows, in Lamp d, when the relation of $0.0018\times150+0.190\geqq C\geqq0.0011\times150+0.171$ was satisfied (e.g. 0.34 mm, 0.40 mm, and 0.46 mm), under both conditions of maximum lighting and dimming control, the luminous flux maintenance factor at the lighting elapse time of 9000 hours is 60% or above, which satisfies the above-stated evaluation criterion, and non-lighting did not occur. As opposed to this, when the relation of $0.0018\times150+0.190\geqq C\geqq0.0011\times150+0.171$ was not satisfied (e.g. 0.30 mm), the inner surface of the arc tube 5 was considerably blackened under the maximum lighting. In addition, the luminous flux maintenance factor at the lighting elapse time of 9000 hours was below 60%, which is below the above-stated evaluation criterion. In addition, under the maximum lighting, non-lighting was caused even during the rated life. Furthermore, when the diameter C of the electrode rods is 0.47 mm, for example, there was no occurrence of non-lighting during the rated life in any of the conditions of maximum lighting and dimming control. However under the dimming control, the inner surface of the arc tube 5 was considerably blackened, and the luminous flux maintenance factor at the lighting elapse time of 9000 hours is below 60%, which fails to satisfy the above-stated evaluation criterion.

In this way, it is confirmed that, when the diameter C (mm) of the electrode rods 22 satisfies the relation of $0.0018\times150+0.190\geqq C\geqq0.0011\times150+0.171$, the luminous flux maintenance factor is prevented from decreasing as well as restraining the occurrence of non-lighting during the rated life.

The result is considered attributable to the following reason.

When the diameter C (mm) of the electrode rods 22 is above the value of $0.0018\times150+0.190$, the current density of the electric current flowing the electrode rods 22 under dimming control decreases, to reduce the temperature at the tip of each electrode 21. The reduction in temperature is most significant at the tip of each electrode 21. As a result, it becomes impossible to maintain discharge from the entire surface of the tip of each electrode 21. According to this phenomenon, point discharge tends to be generated at the tip of each electrode 21. In the occurrence of point discharge, only the point of the point discharge will have extremely high heat, thereby evaporating the tungsten constituting the electrodes 21 in the large amount. The evaporated tungsten will then attach to the inner surface of the arc tube 5, to reduce the quantity of light emitted from the arc tube 5 to outside. Conversely, when the diameter C (mm) of the electrode rods 22 is below the value of $0.0011\times150+0.171$, the current density of the electric current flowing the electrode rods 22 under maximum lighting becomes high, to cause the temperature at the tip of each electrode 21 to be extremely high. As a result, a large amount of the tungsten constituting the electrodes 21 will evaporate to attach to the inner surface of the arc tube 5, to reduce the quantity of light emitted from the arc tube 5 to outside. In addition, the reason for the non-lighting of the lamp d during the rated life is considered as follows. Due to the extreme increase in temperature, the electrode rods 22 are distorted to enlarge the distance Le between the electrodes 21. On the other hand, when the relation of $0.0018P+0.190\geqq C\geqq0.0011P+0.171$ is satisfied, both under maximum lighting and dimming control, the electrodes 21 are considered to have maintained an adequate temperature.

In the above tests, dimming control was performed at 60% of the rated lamp power. However, it is confirmed that the same result as in the above description is obtained at least when the dimming control is performed in the range of 60% to 100% of the rated lamp power. In addition, the maximum lamp power P was 150 W in the above tests. However, similar tests have conducted under conditions where the maximum lamp power P is in the range of 70 W to 250 W, and the similar result to the above cases was obtained. Therefore, it can be said that the luminous flux maintenance factor is prevented from decreasing as well as occurrence of non-lighting of the lamp is restrained, if the relation of $0.0018P+0.190\geqq C\geqq0.0011P+0.171$ is satisfied where the maximum lamp power P is in the range of 70 W to 250 W.

In the embodiment described above, adopted rare earth metal halides are a combination of dysprosium iodide, thulium iodide, and holmium iodide. However, rare earth metal halides are not limited to such a combination, and at least one of the following rare earth metal halides may be used for obtaining the same effect as stated above: dysprosium halide, thulium halide, holmium halide, cerium halide, and praseodymium halide. Needless to say, rare earth metal halides may be either iodide(s) or bromide(s). Alternatively, rare earth metal halides may include both of iodide(s) and bromide(s).

In addition, only sodium iodide is used in the embodiment, as sodium halide. However, the same effect as stated above is obtained if only sodium bromide (NaBr) is used as sodium halide, or if both of sodium iodide and sodium bromide are used.

Needless to say, the same effect as stated above is obtained if publicly-known metal halides are added to these metal halides for the purpose of obtaining a desired color characteristic and so on, where the publicly-known metal halides includes calcium iodide ($CaI_2$), lithium iodide (LiI), indium iodide (InI), and scandium iodide ($ScI_3$).

In the embodiment, the main tube 17 of the envelope 19 includes: a first tubular portion 14, tapering portions 15, and second tubular portions 16. However, the same effect as stated above is obtained if the main tube 17 is in any of the conventional forms, such as in a simply tubular form, and a tubular form except that each end thereof is formed like a hemisphere. In addition, the material used for the envelope 19 is polycrystalline alumina in the embodiment. However, the same effect as stated above is obtained if, for example, the envelope 19 is made of translucent ceramic such as yttrium-aluminum-garnet (YAG), yttria, and zirconia.

In the embodiment, the tube wall load during the lamp's lighting under the maximum lamp power was set as 27 $W/cm^2$. However, the same effect as stated above is obtained if the tube wall load during the lamp's lighting under the maximum lamp power is set in the range of 20 $W/cm^2$ to 38 $W/cm^2$. It is, however, preferable that the tube wall load is set in the range of 25 $W/cm^2$ to 30 $W/cm^2$, for the purpose of effectively restraining the non-lighting of the lamp incident to increase in lamp voltage before ending of the rated life, and for the purpose of preventing the color characteristics and lamp efficiency from decreasing.

Furthermore, in the metal halide lamp 1 of the embodiment, the arc tube 5 is placed in the outer tube 3 to which the base 4 has been provided. However, if the arc tube 5 is adopted to other types of publicly-known metal halide lamps such as a PAR type, the same effect as stated above is obtained.

Figure 6:
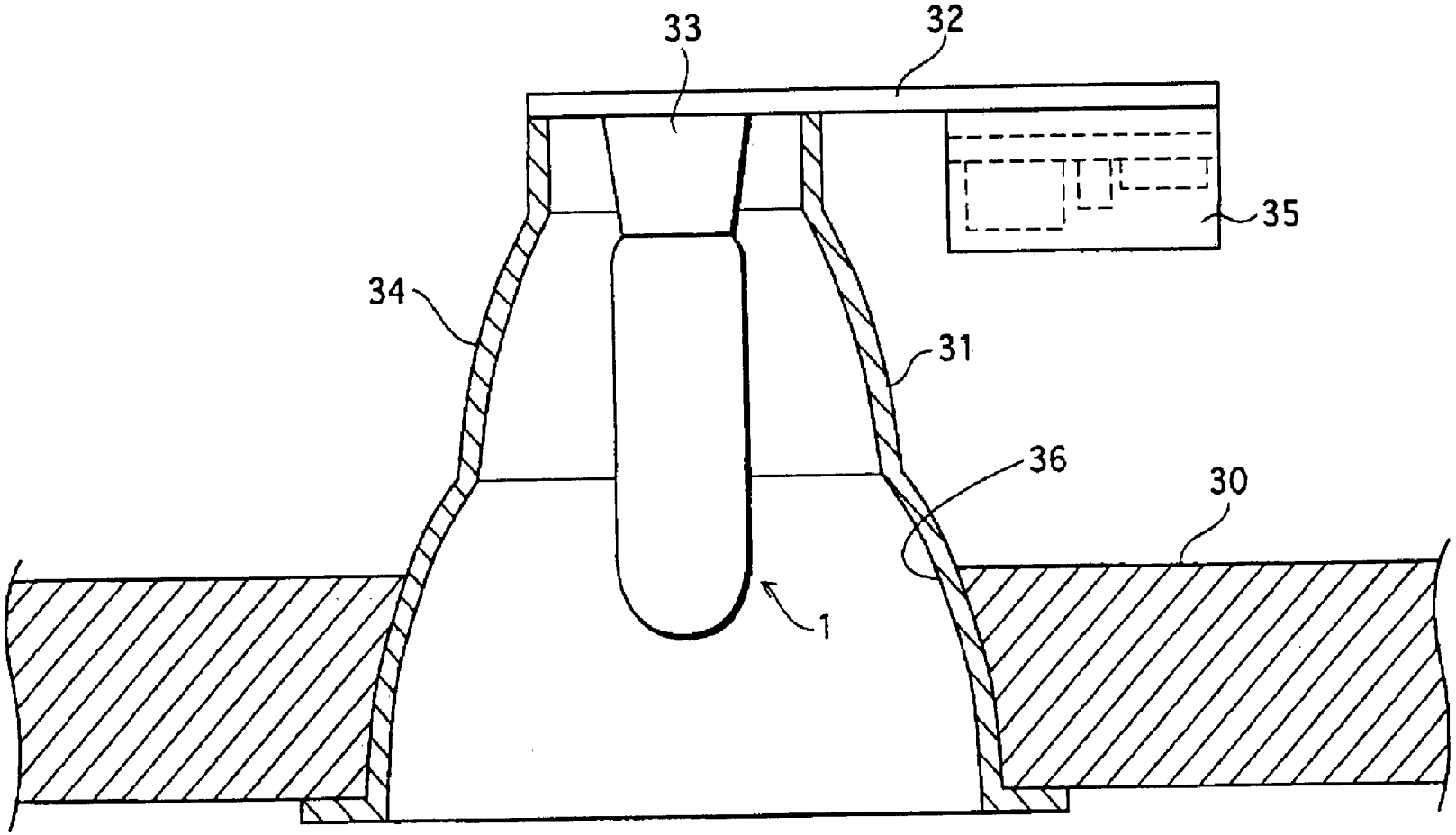
FIG. 6 is a front view of a lighting apparatus according to an embodiment of the present invention, which is partly cut.

The following describes a lighting apparatus according to the present invention. As FIG. 6 shows, the lighting apparatus is for use by being attached to a ceiling, or the like, and includes: a luminaire 34; a metal halide lamp 1 according to the embodiment of the present invention; and an electronic ballast 35. The luminaire 34 includes: a reflector 31 having a form like an umbrella and being incorporated in a ceiling 30; a base 32 in a plate form, attached to the bottom of the reflector 31; and a socket 33 attached to the inner bottom of the reflector 31. The metal halide lamp 1 is provided for the socket 33 of the luminaire 34. The electronic ballast 35 is attached to the base 32, at a position separate from the reflector 31.

Note that the form and the like of a reflection surface 36 of the reflector 31 are to be designed in an appropriate manner, depending on the use and the use conditions.

The electronic ballast 35 is a conventional electronic ballast.

As stated above, the lighting apparatus of the present invention adopts the metal halide lamp of the present invention described above. Therefore, the lighting apparatus is able to obtain a desired color characteristic, and hardly causes non-lighting of the lamp.

The lighting apparatus is explained to be for use by being attached to a ceiling. However, the lighting apparatus may also be used as other types of indoor lighting, shop lighting, and outdoor lighting. The range of use of the lighting apparatus should not be particularly limited. In addition, various types of conventional luminaires and electronic ballasts are usable depending on how the lighting apparatus is used.

The present invention is industrially applicable. For example, the present invention is applicable to any types of metal halide lamp capable of being dimmed, and to any lighting apparatus adopting such a metal halide lamp. According to the present invention, it is possible to prevent non-lighting due to leakage of an arc tube attributable to a crack occurring at the thin tubes, as well as realizing a desired color characteristic. Therefore, the present invention is of great utility value in the industry.

Although the present invention has been fully described by way of examples with references to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A metal halide lamp capable of being dimmed comprising:

an arc tube that includes an envelope made of a translucent ceramic, a pair of electrodes, and metal halides, the metal halides including rare earth metal halide, sodium halide, and magnesium halide, the rare earth metal halide being at least one of dysprosium halide, thulium halide, holmium halide, cerium halide, and praseodymium halide, and the magnesium halide being at least one of magnesium iodide and magnesium bromide, wherein when a maximum lamp power P (W) is in a range of 70 W to 250 W, the following relations are satisfied:

$$0.0345A+0.0028B<0.0015P+0.0475,$$

$$A\geqq=0.021P+0.313, \text{ and}$$

$$B\geqq=10.0,$$

where A (mg) represents a total content of the metal halides excluding mercury halide if any, and B (mol%) represents a content ratio of the magnesium halide to the metal halides excluding mercury halide if any.

2. A metal halide lamp according to claim 1,wherein each of the pair of electrodes is made of an electrode rod and an electrode coil provided at a tip of the electrode rod, and where C (mm) represents a diameter of the electrode rod, the following relation is satisfied:

$$0.0018P+0.190\geqq=C\geqq=0.0011P+0.171.$$

3. A lighting apparatus comprising a metal halide lamp according to claim 2.

4. A metal halide lamp according to claim 1 wherein the arc tube includes a main tube and an upper and lower thin tube, which are smaller in diameter than the main tube with a wall thickness $t_1$ of $$0.9 \text{ mm}\leqq t_1\leqq 1.3 \text{ mm}.$$

5. A metal halide lamp according to claim 1 wherein the arc tube includes mercury and a start auxiliary gas selected from argon, xenon and a mixture of xenon and argon.

6. A metal halide lamp according to claim 1 wherein the arc tube has a lighting elapse time life of 9000 hours.

* * * * *